United States Patent [19]

Keating et al.

[11] 4,358,910

[45] Nov. 16, 1982

[54] SECURITY GATE

[76] Inventors: Terence J. Keating, 74 Westgarth Rd., Exeter, Devon; Gordon T. Bond, 8 King's Lear, Ilton, Ilminster, Somerset, both of England

[21] Appl. No.: 166,574

[22] Filed: Jul. 7, 1980

[30] Foreign Application Priority Data

Jun. 27, 1979 [GB] United Kingdom ..... 7922292

[51] Int. Cl.[3] ..... E06B 3/68

[52] U.S. Cl. ..... 49/56; 49/394

[58] Field of Search ..... 49/56, 50, 67, 63, 57, 49/394

[56] References Cited

U.S. PATENT DOCUMENTS

| | | | |
|---|---|---|---|
| 999,682 | 8/1911 | Suits | 49/56 X |
| 1,854,153 | 4/1932 | Ammen | 49/56 |
| 1,960,015 | 5/1934 | Kitzelman | 49/56 X |
| 1,979,808 | 11/1934 | Mussbach | 49/56 X |
| 2,668,729 | 2/1954 | Watters . | |
| 3,953,939 | 5/1976 | Klein | 49/56 |
| 4,059,923 | 11/1977 | Sauer . | |
| 4,249,345 | 2/1981 | Littleton | 49/56 |

FOREIGN PATENT DOCUMENTS

| | | |
|---|---|---|
| 19301 | 8/1904 | Fed. Rep. of Germany . |
| 261328 | 7/1912 | Fed. Rep. of Germany . |
| 395190 | 7/1933 | United Kingdom . |
| 731197 | 6/1955 | United Kingdom . |
| 1422931 | 1/1976 | United Kingdom . |

OTHER PUBLICATIONS

Patents Abstracts of Japan, vol. 2, No. 5, Jan. 13, 1978, p. 6521M77.

*Primary Examiner*—Philip C. Kannan

*Attorney, Agent, or Firm*—Mawhinney & Mawhinney & Connors

[57] ABSTRACT

A security gate for a window or other aperture of a building includes a grille which is hingedly mounted at one side to a frame member which is secured within the aperture. The ends of the bars of the grille opposite the hinge enters slots in part of the frame and are secured therein by a locking bar. The arrangement provides a secure closure for the opening yet permits egress from the interior of the building in the event of fire or other hazard.

6 Claims, 5 Drawing Figures

SECURITY GATE

BACKGROUND TO THE INVENTION

This invention relates to a security gate for a window or other aperture of a building.

It is well-known to render a window or other aperture of a building more secure against intrusion by the disposition in the window of a frame which serves as a fixture for a grille of which the bars are firmly secured against removal. However, the very security of such a grille may be dangerous to people within the building if there is a fire or other hazard which requires those people to escape rapidly from the building. It is the object of the present invention to alleviate this danger.

SUMMARY OF THE INVENTION

The preferred embodiment of the present invention comprises a security gate which includes a frame which fits into and is preferably secured within a corresponding aperture, large enough for personal egress in a wall. A grille is hingedly mounted at one side. At least one channel or rebate is formed in or constituted by the frame and has apertures for the reception of the ends of bars of the grille. A lockable bar is provided for securing those ends of the bars of the grille.

In one embodiment of the invention the frame is secured to the inside of the window or other aperture and one side of the grille is hingedly connected to the frame at that side. The ends of the bars of the grille along, preferably, the opposite side enter slots in the corresponding member of the frame as the grille is closed and the ends of the bars are secured by means of a locking bar which engages slots in the frame.

BRIEF DESCRIPTION OF THE ACCOMPANYING DRAWINGS

DESCRIPTION OF THE PREFERRED EMBODIMENTS

Figure 1:
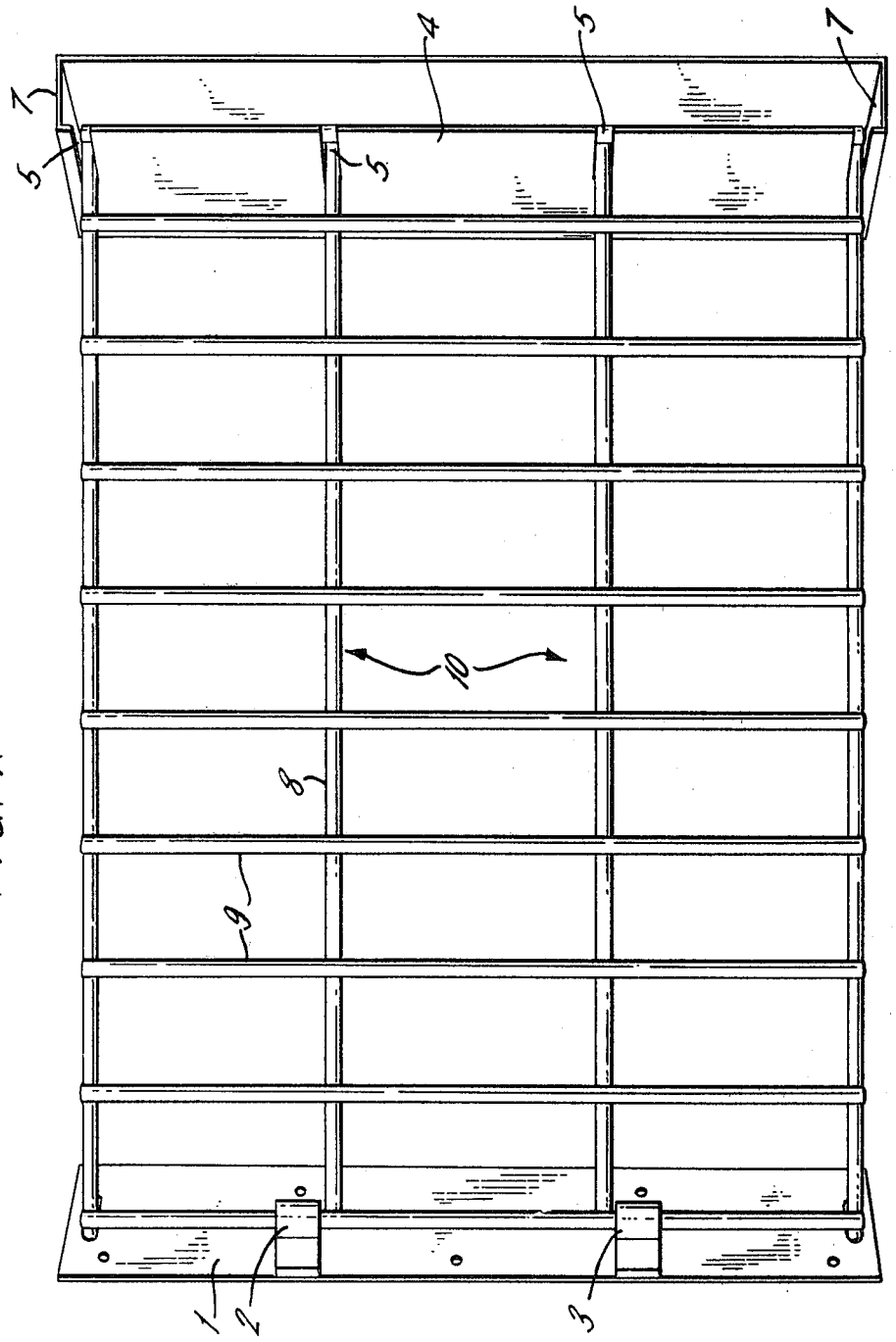
FIG. 1 illustrates part of a first embodiment of the invention.

Reference will first be made to the embodiment illustrated by FIGS. 1 to 4 inclusive. In this embodiment, one part of a frame is constituted by a fixing plate 1 which can be attached to a wall and is intended for fitment into one side of a window opening. The plate 1 may be made of 10 SWG mild steel sheet. It carries two heavy duty (36 mm × 12 mm) mild steel hinges 2 and 3. To the other side of the window is secured a further member which comprises a mild steel box 4 which is open at one side and which has in one broad face slots 5 that extend from one longitudinal edge partly across that broad face.

A grille 8 is constituted by mild steel bars of 13 mm diameter. The bars comprise a row of vertical bars 9 and a row of horizontal bars 10. The bars are welded together at the interceptions of the horizontal and vertical bars. The leftmost vertical bar, as shown in the drawing, is received in the hinges 2 and 3. The ends of the horizontal bars remote from the hinge are received in the slots 5 of the box 4 when the gate is closed.

Figure 2:
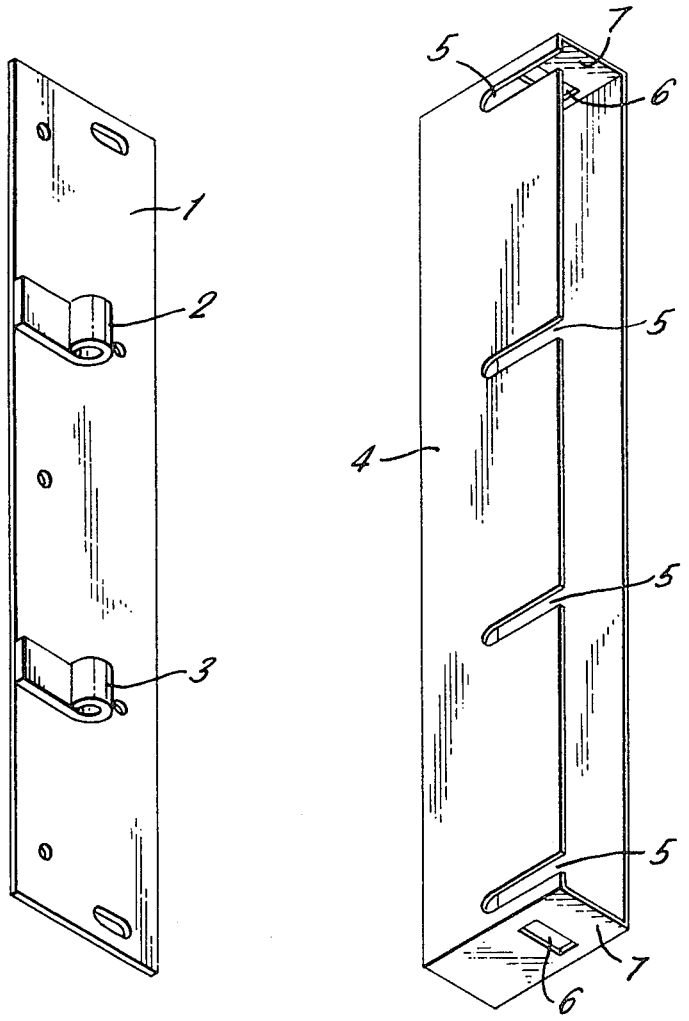
FIGS. 2, 3 and 4 illustrate details of the first embodiment of the invention.
Figure 3:
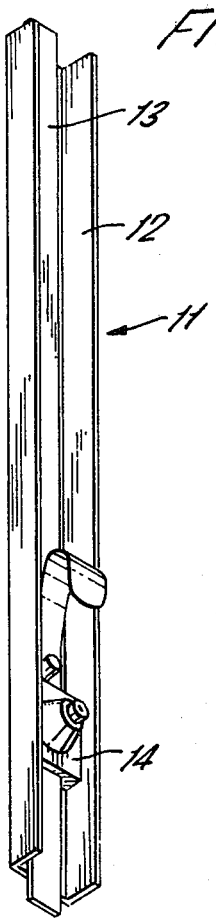
Figure 4:
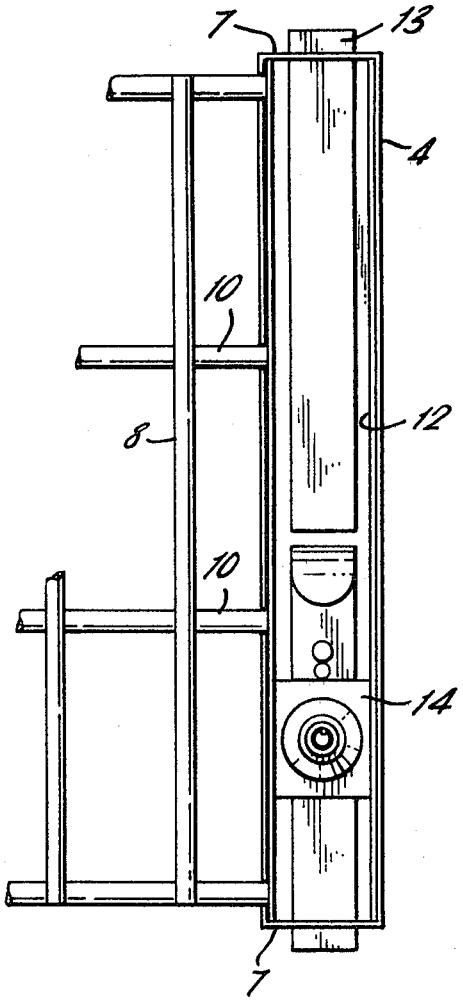

FIG. 3 of the drawings shows a locking bar 11 which comprises a channel member 12 and an operating bar 13 securable relative to the channel by a lock 14. As is illustrated in FIG. 4, the ends of the locking bars can be inserted in one or other of the slots 6 which are provided in each narrow end face 7 (FIG. 2) of the box 4, the other slots 6 at the other end of the box being engaged by sliding movement of the locking bar. Thus the locking bar can be used to secure the ends of the bars 10 in position.

The purpose of the embodiment as thus described is to provide a secure grille across the window opening but to enable the opening of the grille as necessary from the inside of the building so that the window may be used for an exit if there is a fire or other hazard within the building. It is desirable for the lock to be inaccessible from the exterior of the building. In the described embodiment the lock is within a channel which cannot be directly reached from the exterior of the building though it is readily possible to make the lock even more inaccessible by appropriate modification of the grille.

Figure 5:
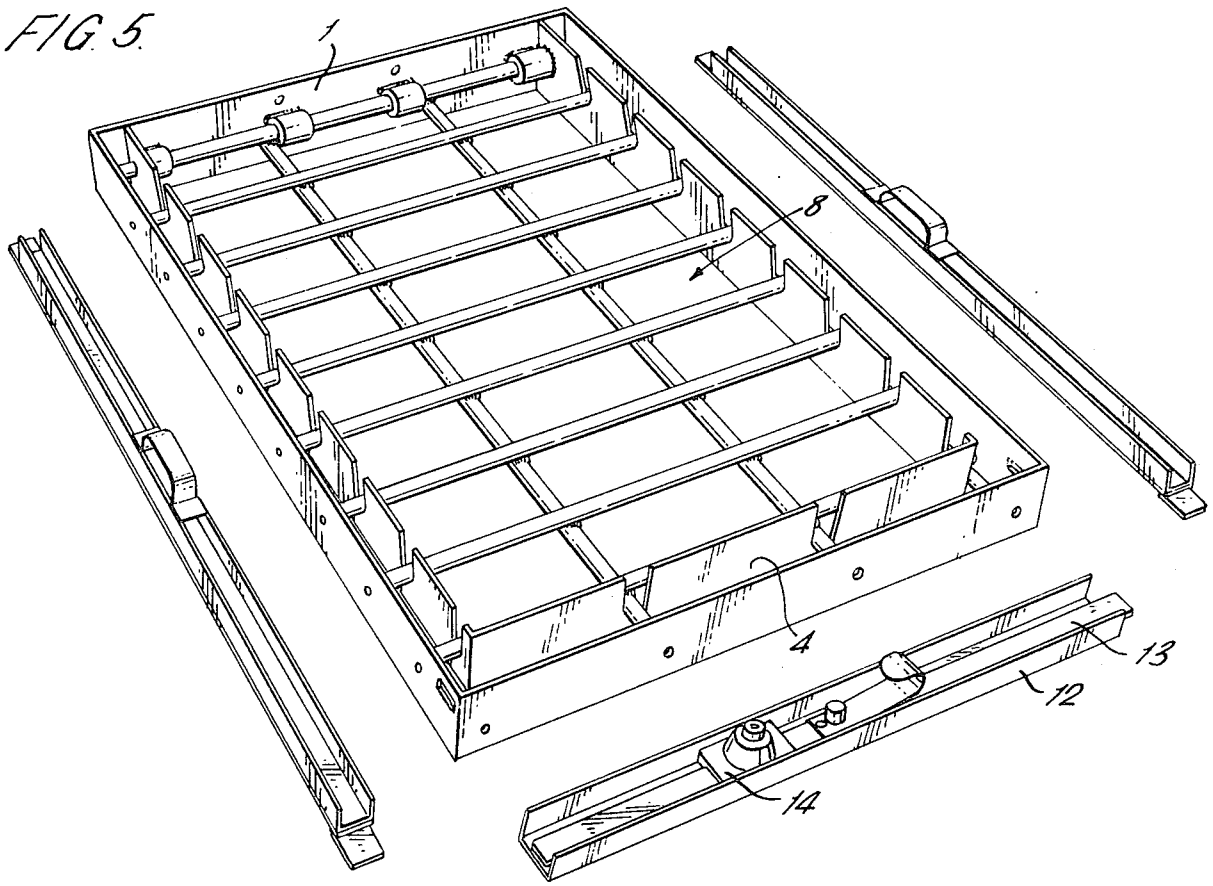
FIG. 5 illustrates a second embodiment of the invention.

FIG. 5 illustrates another embodiment in which the fixing plate 1 and the box 4 form part of a common frame 20 the members of which are welded together so as effectively to form a one-piece frame. This frame 20 has a top wall 21, a bottom wall 22 and an end side wall 23 opposite the plate 1, an inner top wall 24, an inner bottom wall 25 and an inner end side wall 26, which are connected by respective plates, not shown, to the respective walls 21, 22 and 23, so that in effect an open channel is formed along each of the three sides of the frame other than the side constituted by the fixing plate 1. Each of the inner walls 24, 25 and 26 is slotted so that the respective channel can receive the adjacent ends of the appropriate bars; in FIG. 5 the grille is shown closed, the ends of the bars all being received in their respective slots and lying within the channels.

As described hereinbefore, a locking bar 11, comprising channel member 12, an operating bar 13, and a lock 14, can be used to secure the respective ends of the bars of the grille within the channel formed by the walls 23 and 26, the ends of the locking bars being engageable in the slots 6 provided one at each end of the channel in a manner similar to that shown in FIG. 2 for the box 4. For each of the longitudinal channels, formed by the walls 21, 24 and 22, 25 respectively, there is a securing bar 28, 29 respectively. The two bars are similar; each has a tongue 30 at one end for fitment into a slot at the hinge end of the respective channel and a tongue 31 which fits under the channel 12 of the locking bar 11.

The details of the locking bar are, for the most part, unimportant; the bar may be constructed in a manner known in itself. It is only necessary that the lock 14 be capable of easy release so that, if threatened personnel require to leave the building, the lock 14 can be quickly released and the grille swung open quickly.

We claim:

1. A security gate comprising a grille constituted by bars; at least two frame members which fit along opposite sides of an aperture, large enough for personal egress, in a wall, said frame members including a first frame member incorporating a hinge means mounting said grille, and a second frame member comprising a channel member which has slots for the reception of the ends of bars along another side of the grille; and a locking bar which locks into position within the channel member for securing the ends of the said bars within the slots.

2. A security gate according to claim 1 wherein the channel member is disposed opposite the first member.

3. A security gate according to claim 2 wherein a channel as aforesaid is formed in a frame member extending along a side of the grille adjacent the side at which the grille is hingedly mounted.

4. A security gate comprising a rectangular frame having hinge members disposed along one side thereof and including means defining channels along the other sides of said frame; a grille which is hingedly mounted along the first side of the frame and is constituted by bars; means defining slots in said channels, said slots receiving respective ends of said bars whereby the ends of the bars extend into said channels; and a locking bar which is securable along one of said channels so as to secure the respective ends of the respective bars of the grille within said one channel.

5. A security gate comprising:

(a) a grille constituted by bars;

(b) a frame for fitment within an aperture, large enough for personal egress, in a wall, said frame comprising a first member providing a hinge mounting for said grille and a channel member having slots for the reception of ends of said bars remote from the hinge mounting, said channel member including end members each of which defines a locating slot; and, (c) a locking bar for engagement with said locating slots, said locating slots being positioned so that said locking bar lies within and along said channel member so as to secure the said ends of said bars within said channel member.

6. A security gate comprising:

(a) a grille constituted by bars;

(b) a rectangular box frame comprising four side members;

(c) hinge means for said grille, said hinge means being mounted on a first of said side members;

(d) inner side members extending along a second, third and fourth of said side members, each inner side member forming with the respective second, third and fourth side member a respective channel;

(e) means defining slots in each of said inner side members for the reception of respective ends of said bars into the respective channel;

(f) means defining a locating slot in said frame at each end of at least one of said channels; and (g) at least one locking bar engageable in the said locating slots in said frame, whereby said locking bar is fixed to lie within said one channel and secures the respective ends of the bars therein.

* * * * *